US007443996B2

(12) United States Patent
Funahashi et al.

(10) Patent No.: US 7,443,996 B2
(45) Date of Patent: Oct. 28, 2008

(54) LOUDSPEAKER

(75) Inventors: Osamu Funahashi, Osaka (JP); Hiroyuki Morimoto, Mie (JP); Yukio Okamoto, Aichi (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 322 days.

(21) Appl. No.: 11/418,143

(22) Filed: May 5, 2006

(65) Prior Publication Data

US 2006/0215871 A1 Sep. 28, 2006

Related U.S. Application Data

(62) Division of application No. 10/333,960, filed as application No. PCT/JP02/05722 on Jun. 10, 2002, now Pat. No. 7,209,570.

(30) Foreign Application Priority Data

Jun. 11, 2001 (JP) ..... 2001-175149
Apr. 15, 2002 (JP) ..... 2002-111717

(51) Int. Cl.
*H04R 25/00* (2006.01)

(52) U.S. Cl. ..... 381/398; 381/403; 381/423

(58) Field of Classification Search ..... 381/396, 381/397, 398, 400, 403, 404, 407, 423–428, 381/431, 432, 184, 186; 181/171, 172, 173, 181/163–165

See application file for complete search history.

(56) References Cited

U.S. PATENT DOCUMENTS 5,583,944 A 12/1996 Morohoshi et al.
5,847,333 A * 12/1998 D'Hoogh ..... 181/171
6,031,925 A * 2/2000 Shteyn ..... 381/401
6,236,733 B1 * 5/2001 Kato et al. ..... 381/423

(Continued)

FOREIGN PATENT DOCUMENTS

EP 0 836 362 4/1998

(Continued)

OTHER PUBLICATIONS

Supplementary European Search Report issued Jan. 10, 2007 in International (PCT) Application No. PCT/JP0205722, which the present application is the U.S. National Stage.

*Primary Examiner*—Huyen D Le
(74) *Attorney, Agent, or Firm*—Wenderoth, Lind & Ponack, L.L.P.

(57) ABSTRACT

A high efficiency loudspeaker without a damper is provided. The loudspeaker includes magnetic circuit having a magnetic gap and a voice coil member, which has movable coil, disposed in the magnetic gap of the magnetic circuit. The loudspeaker also includes a diaphragm, whose inner peripheral part is linked with the voice coil member, outside the magnetic gap and a frame linked with an outer peripheral part of the diaphragm via a first edge. An inner peripheral part of a suspension holder is linked with the voice coil member at a linked position which is closer to the magnetic circuit than a linked position of the diaphragm and the voice coil member. An outer peripheral part of the suspension holder is linked with a frame via a second edge. The first edge and the second edge are substantially symmetrical with each other about a median of a first edge and a second edge.

23 Claims, 24 Drawing Sheets

U.S. PATENT DOCUMENTS

| | | | | |
|---|---|---|---|---|
| 7,209,570 | B2 * | 4/2007 | Funahashi et al. | 381/398 |
| 7,324,659 | B2 * | 1/2008 | Funahashi et al. | 381/398 |

FOREIGN PATENT DOCUMENTS

| | | |
|---|---|---|
| JP | 45-32035 | 10/1970 |
| JP | 59-77797 | 5/1984 |
| JP | 08-102993 | 4/1996 |
| JP | 10-066193 | 3/1998 |
| JP | 11-150791 | 6/1999 |
| WO | 99/66763 | 12/1999 |
| WO | 02/065811 | 8/2002 |

* cited by examiner

LOUDSPEAKER

This application is a divisional application of application Ser. No. 10/333,960, filed May 14, 2003, now U.S. Pat. No. 7,209,570, which is a U.S. National Stage application of International Application No. PCT/JP02/05722, filed Jun. 10, 2002.

TECHNICAL FIELD

The present invention relates to a loudspeaker.

BACKGROUND ART

As shown in FIG. 22, a structure of a conventional loudspeaker includes a magnetic circuit 1, voice coil member 4, diaphragm 5 and frame 7. The voice coil member 4, which has movable coil 3, is disposed in a magnetic gap 2 of the magnetic circuit 1. An inner peripheral part of the diaphragm 5 is linked with the voice coil member 4 outside the magnetic gap 2. An outer peripheral part of the diaphragm 5 is linked with the frame 7 via an edge 6. An electric signal, which is supplied from an audio amplifier and the like, is input to the coil 3 of the voice coil member 4, and the voice coil member 4 is then excited. As a result, force is transmitted to the diaphragm 5, and then the diaphragm 5 vibrates air, thereby changing the electric signal into sound.

As shown in FIG. 22, an inner peripheral part of a damper 8 is fixed between the coil 3 of the voice coil member 4 and a fixed point of the inner peripheral part of the diaphragm 5. An outer peripheral part of the damper 8 is fixed at the frame 7. A damper 8 and an edge 6 form a suspension, and prevent the voice coil member 4 from rolling during operation. As shown in FIG. 22, the damper 8 is formed of a plurality of wave shapes for reducing a mechanical load of the voice coil member 4.

In this structure mentioned above, in working of the voice coil member 4 toward the magnetic circuit 1 and working of the voice coil member 4 toward an opposite side of the magnetic circuit 1, non-linearity and asymmetry of a mechanical load of the damper 8 becomes large. As a result, large harmonic distortion occurs, and power linearity deteriorates. FIG. 23 shows an amplitude of the diaphragm 5 vs. an input electric power of the loudspeaker, namely power linearity of a conventional loudspeaker having the damper 8. Curve A shows an amplitude characteristic of the diaphragm 5 toward the magnetic circuit 1, and curve B shows an amplitude characteristic of the diaphragm 5 toward an opposite side of the magnetic circuit 1. FIG. 24 shows a harmonic distortion characteristic of the conventional loudspeaker having the damper 8, where curve C shows an output sound pressure of the loudspeaker, curve D shows the second harmonic distortion characteristic and curve E shows the third harmonic distortion characteristic. As mentioned above, the damper 8 is formed of a plurality of wave shapes for reducing a mechanical load of the voice coil member 4, and the damper 8 and the edge 6 form a suspension. As a result, it is difficult to improve non-linearity and asymmetry in the conventional loudspeaker, so that harmonic distortion is not reduced.

SUMMARY OF THE INVENTION

An object of the present invention is to provide a novel arrangement for a loudspeaker which is able to reduce harmonic distortion and improve power linearity and thereby provide increased performance. A loudspeaker according to the present invention comprises: a magnetic circuit including a magnetic gap; a voice coil member disposed in the magnetic gap of the magnetic circuit and having a movable coil; a diaphragm whose inner peripheral part is linked with the voice coil member outside the magnetic gap; and a frame linked with an outer peripheral part of the diaphragm via a first edge; wherein an inner peripheral part of a suspension holder is linked with the voice coil member at a linked position which is closer to the magnetic circuit than the linked position of the diaphragm and the voice coil member; wherein an outer peripheral part of the suspension holder is linked with the frame via a second edge; and wherein the first edge and the second edge are substantially symmetrical with each other about a median of the first edge and the second edge.

The structure mentioned above does not require a damper, thereby providing a loudspeaker for solving the problems of non-linearity and asymmetry of a suspension.

DETAILED DESCRIPTION OF THE PREFERRED EMBODIMENTS

Exemplary embodiments of the present invention are described hereinafter with reference to the schematic drawings and it is emphasized that the drawings do not show actual dimensional relations between respective elements.

First Exemplary Embodiment

Figure 1:
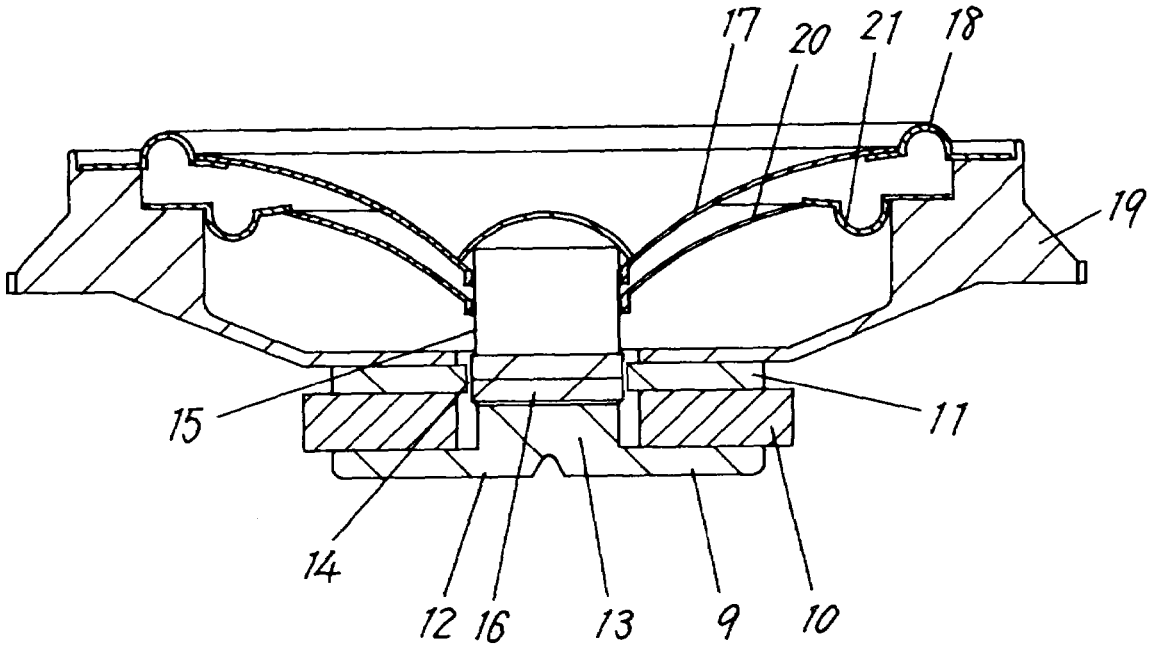
FIG. 1 is a sectional view of a loudspeaker in accordance with a first exemplary embodiment of the present invention.

FIG. 1 is a sectional view of a loudspeaker in accordance with the first exemplary embodiment of the present invention. A magnetic circuit 9 is formed of a ring-shaped magnet 10, ring-shaped plate 11, disk-shaped yoke 12 and columnar pole 13. Magnetic flux of the magnet 10 is concentrated in a magnetic gap 14 between an inner peripheral part of the plate 11 and an outer peripheral part of the pole 13.

Ferromagnetic material, such as a ferrite base magnet, rare-earth cobalt base magnet, and neodymium base magnet, is used as the magnet 10, and soft magnetic material, such as iron, is used as the plate 11, yoke 12 or pole 13. In this invention, the magnetic circuit of an outer magnet type is shown in FIG. 1, however, a magnetic circuit of an inner magnet type can also be used.

The cylindrical voice coil member 15 has a movable coil 16 in the magnetic gap 14 of the magnetic circuit 9, and is formed of a bobbin where a coil such as copper wire is wound. The bobbin is made of a material such as paper, resin or metal.

An inner peripheral part of substantially an inverted cone shape diaphragm 17 is linked with the voice coil member 15 outside the magnetic gap 14. The diaphragm 17 is made of a material, such as pulp or resin, which is light and has high stiffness and moderate internal loss, and is used for making a sound by vibration excited with the voice coil member 15. A ring-shaped first edge 18 is connected with an outer peripheral part of the diaphragm 17, and is made of a material such as urethane, rubber or cloth for reducing a mechanical load of the diaphragm 17.

A frame 19, which has a disk shape, is linked with an outer peripheral part of the diaphragm 17 via a first edge 18. The frame 19 is made of a material formed by iron pressing, resin molding or an aluminum die-casting method, so that a complicated shape can be produced. An inner peripheral part of a suspension holder 20 is linked with the voice coil member 15 at a linked position which is closer to the magnetic circuit 9 than a linked position of the diaphragm 17 and the voice coil member 15. The suspension holder 20 is made of a material, such as pulp or resin, which is light and has high stiffness and large internal loss. An outer peripheral part of the suspension holder 20 is coupled with the frame 19 via a second edge 21. The second edge 21 is made of the same material as the first edge 18 such as urethane, rubber or cloth for reducing a mechanical load of the suspension holder 20.

Figure 2:
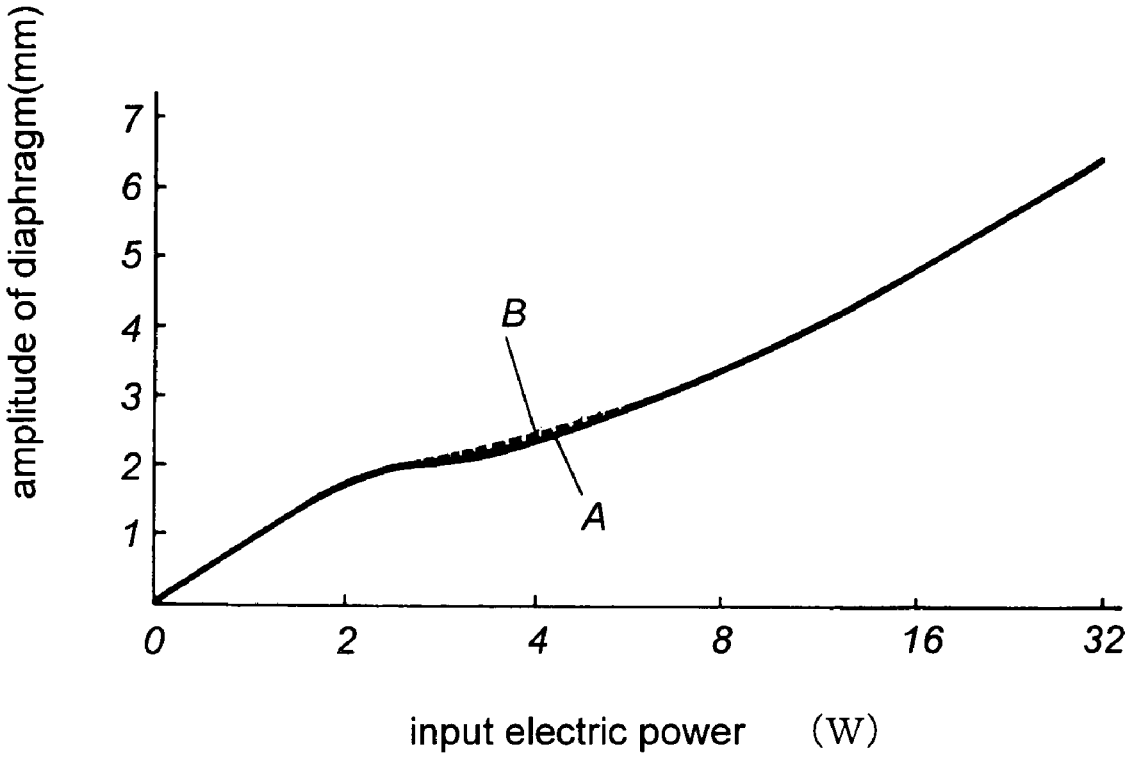
FIG. 2 is a graph showing a characteristic of power linearity of the loudspeaker in accordance with the first embodiment of the invention.
Figure 3:
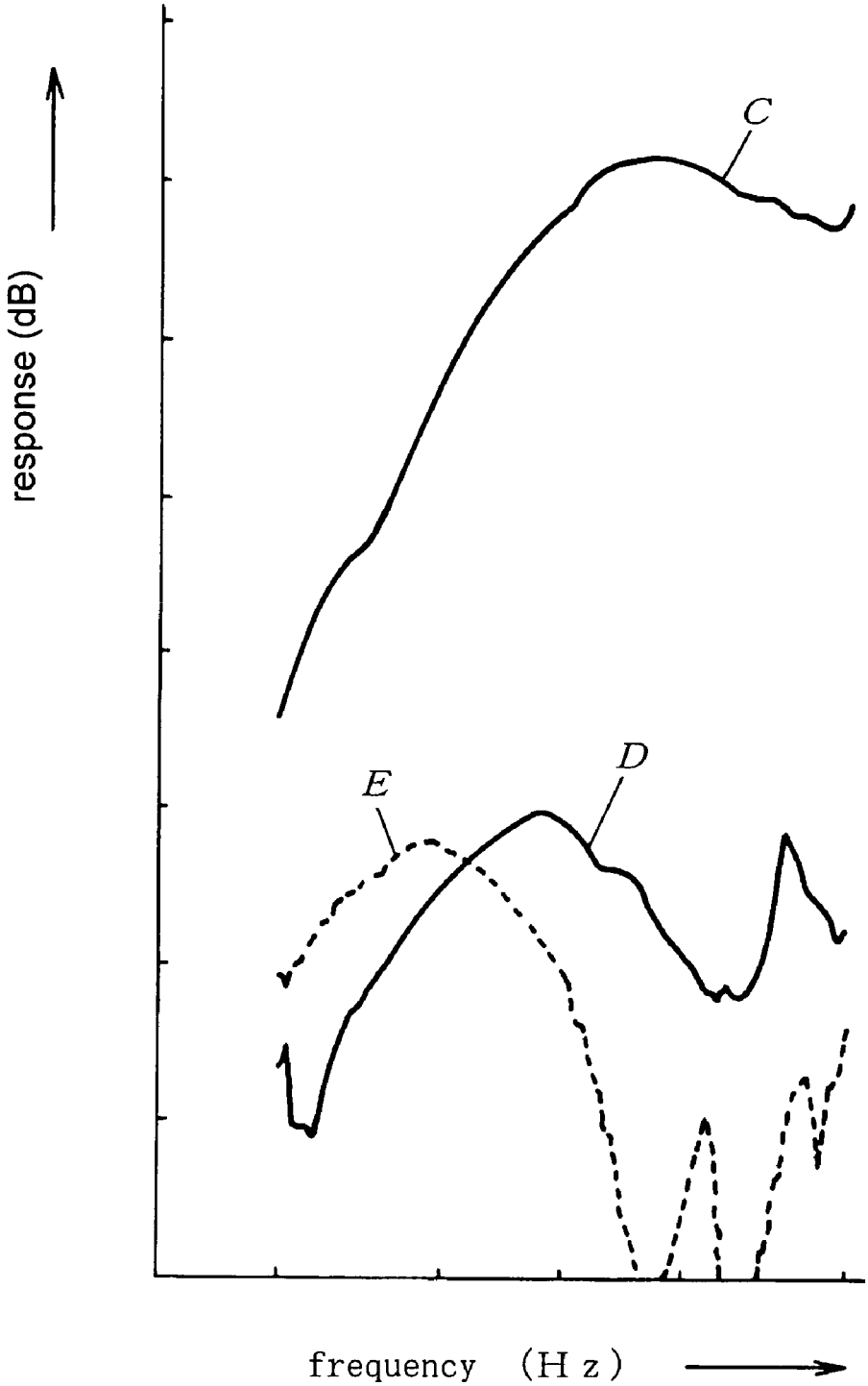
FIG. 3 is a graph showing a characteristic of harmonic distortion of the loudspeaker in accordance with the first embodiment of the invention.

The first edge 18 is protruded toward an opposite side of the magnetic circuit 9. The second edge 21 is protruded toward the magnetic circuit 9, and the first edge 18 and the second edge 21 are substantially symmetrical with analog each other about a median of first edge 18 and second edge 21. FIG. 2 is a graph showing a characteristic of power linearity of the loudspeaker in accordance with the first embodiment of the invention, namely an amplitude of the diaphragm 17 vs. an input electric power. Solid line A shows a characteristic of the input electric power vs. the diaphragm amplitude toward the magnetic circuit 9, and broken line B shows a characteristic of the input electric power vs. the diaphragm amplitude toward the opposite side of the magnetic circuit 9. FIG. 3 is a graph showing a characteristic of harmonic distortion of the loudspeaker in accordance with the first embodiment of the invention, and shows that as a dynamic range of an output sound pressure and harmonic distortion becomes larger, the harmonic distortion becomes smaller. Curve C shows an output sound pressure, curve D shows the second harmonic distortion characteristic and curve E shows the third harmonic distortion characteristic.

The operation of the loudspeaker, whose construction is discussed above, are described hereinafter.

An electric signal, which is supplied from an audio amplifier and the like, is input to the coil 16 of the voice coil member 15, and the voice coil member 15 is excited. As a result, a force is transmitted to the diaphragm 17 causing the diaphragm 17 to vibrate air, thereby changing the electric signal into sound.

Instead of a conventional damper, a suspension formed of a suspension holder 20 and a second edge 21 is provided between the voice coil member 15 and the frame 19. The suspension holder 20, second edge 21 and first edge 18 form a suspension, which prevents the voice coil member 15 from rolling during operation. The first edge 18 and the second edge 21 form the suspension, so that a damper causing non-linearity and asymmetry is not needed. The first edge 18 and the second edge 21 are substantially symmetrical with each other for canceling their own asymmetry. The first edge 18 and the second edge 21 are protruded in an opposite direction with each other. As a result, as shown in the characteristic of the input electric power vs. the diaphragm amplitude of power linearity indicated by solid line A and broken line B of FIG. 2, non-linearity and asymmetry of the suspension can be solved.

Moreover, as shown in the harmonic distortion characteristic of the loudspeaker indicated by curve D and curve E of FIG. 3, the harmonic distortion caused by non-linearity and asymmetry is reduced, so that a high efficiency loudspeaker can be obtained. The diaphragm 17 is not limited to a substantially inverted cone shape, and the same effect can be obtained by using a flat shape.

Second Exemplary Embodiment

Figure 4:
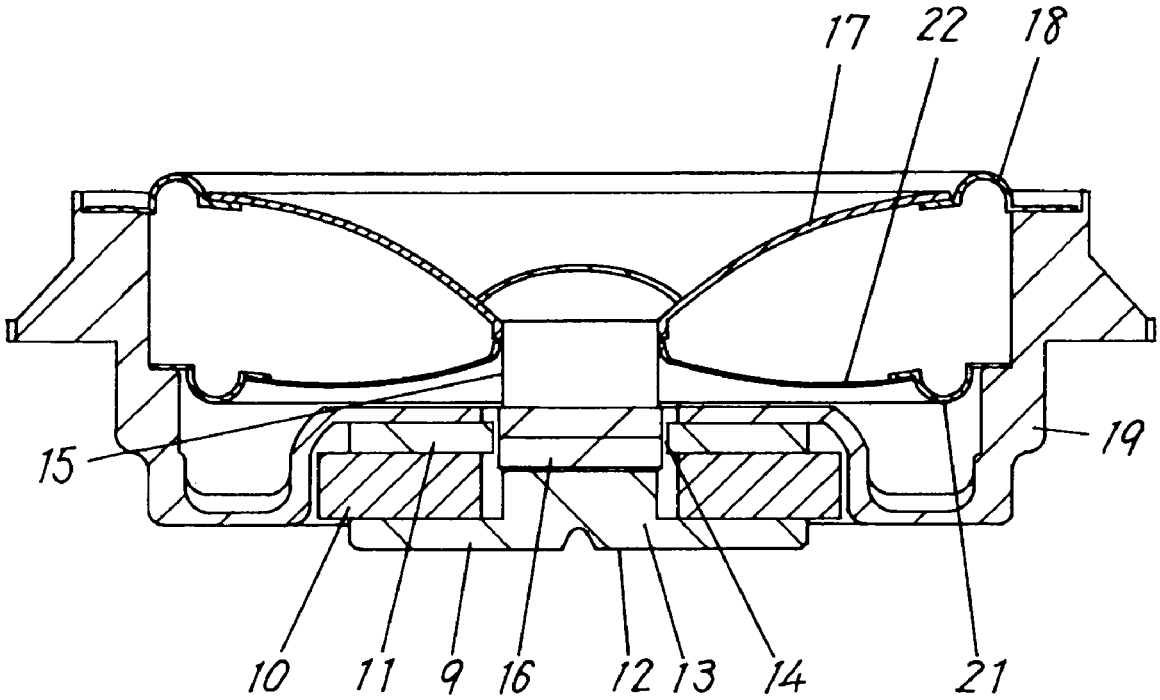
FIG. 4 is a sectional view of a loudspeaker in accordance with a second exemplary embodiment of the present invention.

The second exemplary embodiment is demonstrated hereinafter with reference to FIG. 4. FIG. 4 is a sectional view of a loudspeaker in accordance with the second exemplary embodiment of the present invention. The same constituent elements as in the first exemplary embodiment are identified with the same reference numerals.

In FIG. 4, an inner peripheral part of a substantially cone shape suspension holder 22 is linked with the voice coil member 15 at a linked position which is closer to the magnetic circuit 9 than a linked position of the diaphragm 17 and the voice coil member 15. The suspension holder 22 and the diaphragm 17 are substantially symmetrical with analog each other about a median of the suspension holder 22 and the diaphragm 17. As a result, a long distance between a fulcrum of the first edge 18 and a fulcrum of the second edge 21 can be obtained, thereby preventing the voice coil member 15 from rolling.

Third Exemplary Embodiment

Figure 5:
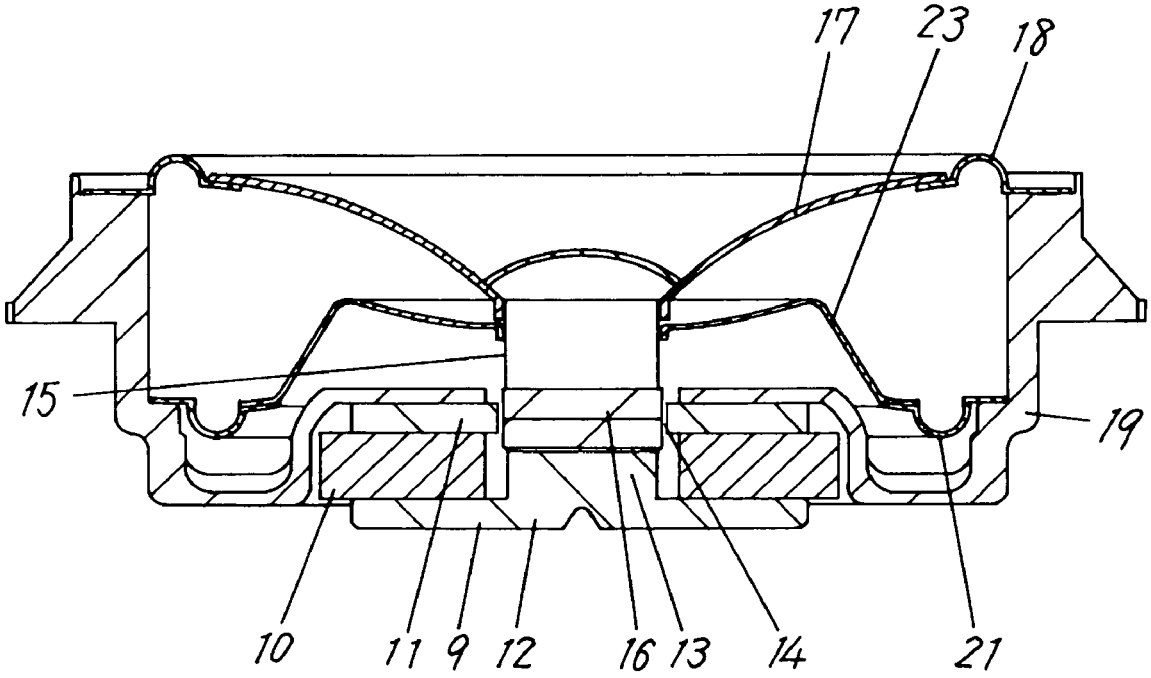
FIG. 5 is a sectional view of a loudspeaker in accordance with a third exemplary embodiment of the present invention.

The third exemplary embodiment is demonstrated hereinafter with reference to FIG. 5. FIG. 5 is a sectional view of a loudspeaker in accordance with the third exemplary embodiment of the present invention. The same constituent elements as in the first and the second exemplary embodiments are identified with the same reference numbers.

In FIG. 5, an inner peripheral part of the suspension holder 23 is linked with the voice coil member 15 at a linked position which is closer to the magnetic circuit 9 than a linked position of the diaphragm 17 and the voice coil member 15. An outer peripheral part of the suspension holder 23 is bent downward. As a result, a distance between a fulcrum of the first edge 18 and a fulcrum of the second edge 21 is expanded maximally, thereby preventing the voice coil member 15 from rolling.

Fourth Exemplary Embodiment

Figure 6:
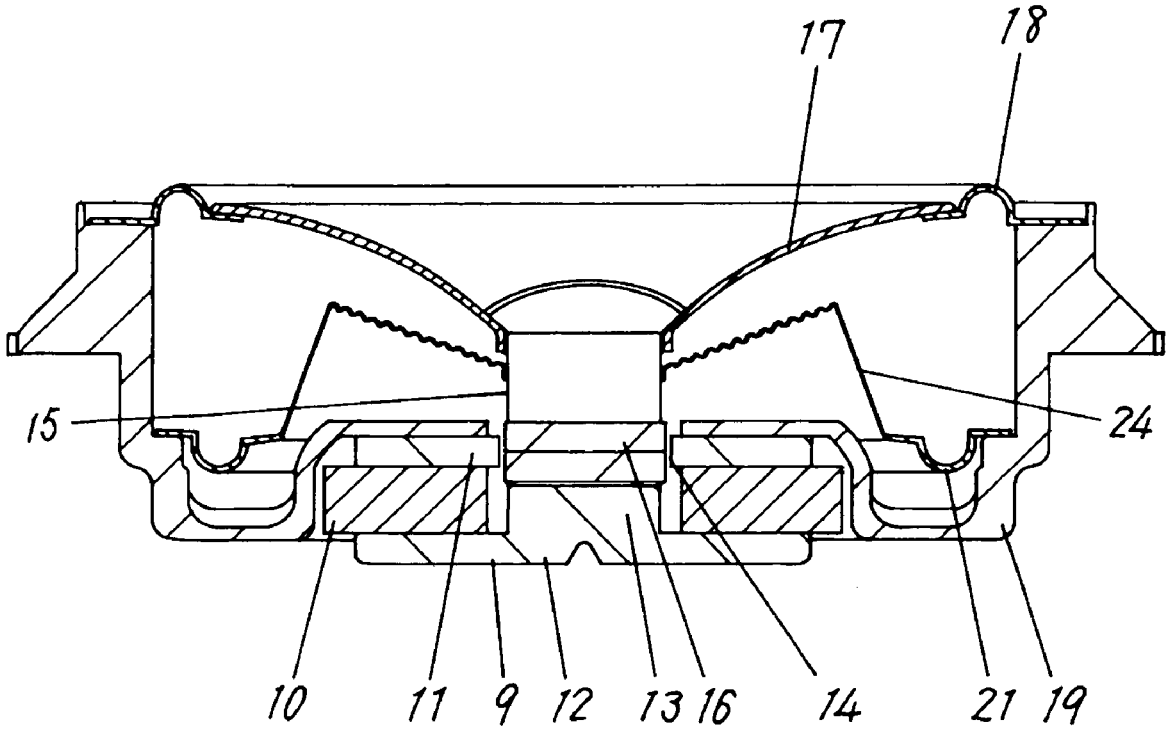
FIG. 6 is a sectional view of a loudspeaker in accordance with a fourth exemplary embodiment of the present invention.

The fourth exemplary embodiment is demonstrated hereinafter with reference to FIG. 6. FIG. 6 is a sectional view of a loudspeaker in accordance with the fourth exemplary embodiment of the present invention. The same constituent elements as described in the first through the fifth exemplary embodiments are identified with the same reference numerals.

In FIG. 6, an inner peripheral part of the suspension holder 24 is linked with the voice coil member 15 at a linked position which is closer to the magnetic circuit 9 than a linked position of the diaphragm 17 and the voice coil member 15. An upper surface of the suspension holder 24 has a corrugated shape. Using the structure discussed above, a response to high acceleration which the first edge 18 and the second edge 21 can not follow is achieved, and resonance of low-frequency to middle-frequency ranges at a low amplitude is absorbed. As a result, a frequency characteristic is leveled, and resonance distortion is reduced.

Fifth Exemplary Embodiment

Figure 7:
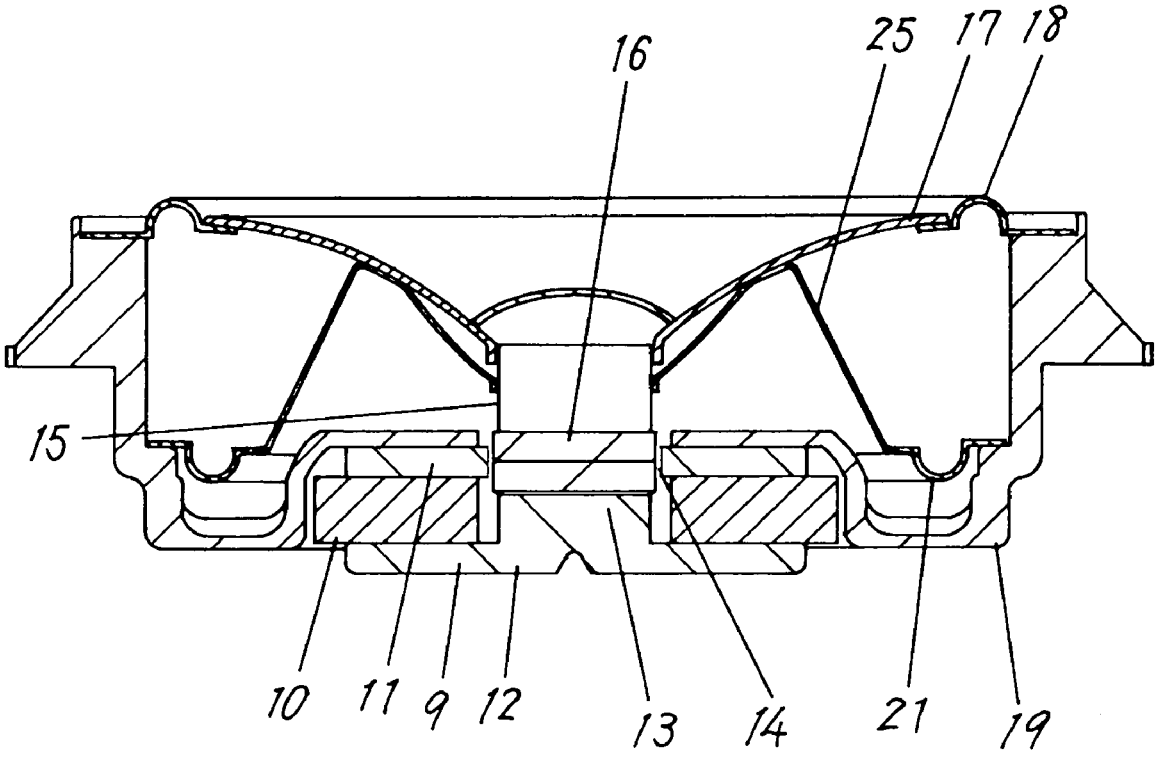
FIG. 7 is a sectional view of a loudspeaker in accordance with a fifth exemplary embodiment of the present invention.

The fifth exemplary embodiment is demonstrated hereinafter with reference to FIG. 7. FIG. 7 is a sectional view of a loudspeaker in accordance with the fifth exemplary embodiment of the present invention. The same constituent elements as described in the first through the fourth exemplary embodiments are identified with the same reference numerals.

In FIG. 7, an inner peripheral part of the suspension holder 25 is linked with the voice coil member 15 at a linked position which is closer to the magnetic circuit 9 than a linked position of the diaphragm 17 and the voice coil member 15. A middle section between the inner peripheral part and an outer peripheral part of the suspension holder 25 is coupled with a middle section of the diaphragm 17 using an adhesive and the like. Using the structure discussed above, the diaphragm 17 substantially has the same phase as the suspension holder 25. As a result, resonance distortion, which is caused by a phase shift between the diaphragm 17 and the suspension holder 25, of low-frequency to middle-frequency ranges is reduced, and a frequency characteristic is leveled.

Sixth Exemplary Embodiment

Figure 8:
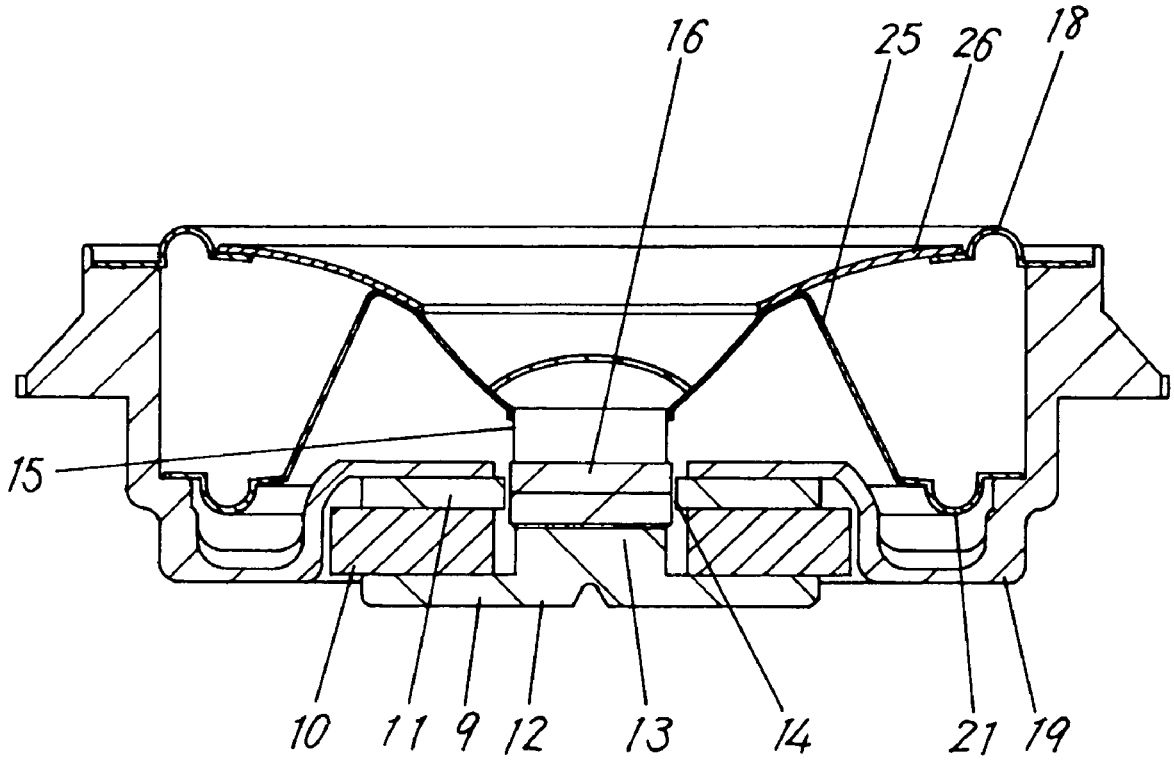
FIG. 8 is a sectional view of a loudspeaker in accordance with a sixth exemplary embodiment of the present invention.

The sixth exemplary embodiment is demonstrated hereinafter with reference to FIG. 8. FIG. 8 is a sectional view of a loudspeaker in accordance with the sixth exemplary embodiment of the present invention. The same constituent elements as described in the first through the fifth exemplary embodiments are identified with the same reference numerals.

In FIG. 8, an inner peripheral part of a substantially inverted cone shape diaphragm 26 is linked with a middle section between an inner peripheral part and an outer peripheral part of the suspension holder 25. An outer peripheral part of the diaphragm 26 is linked with the frame 19 via the first edge 18. Using the structure discussed above, the diaphragm 26 becomes much lighter, so that sound conversion efficiency of the loudspeaker is improved.

Seventh Exemplary Embodiment

Figure 9:
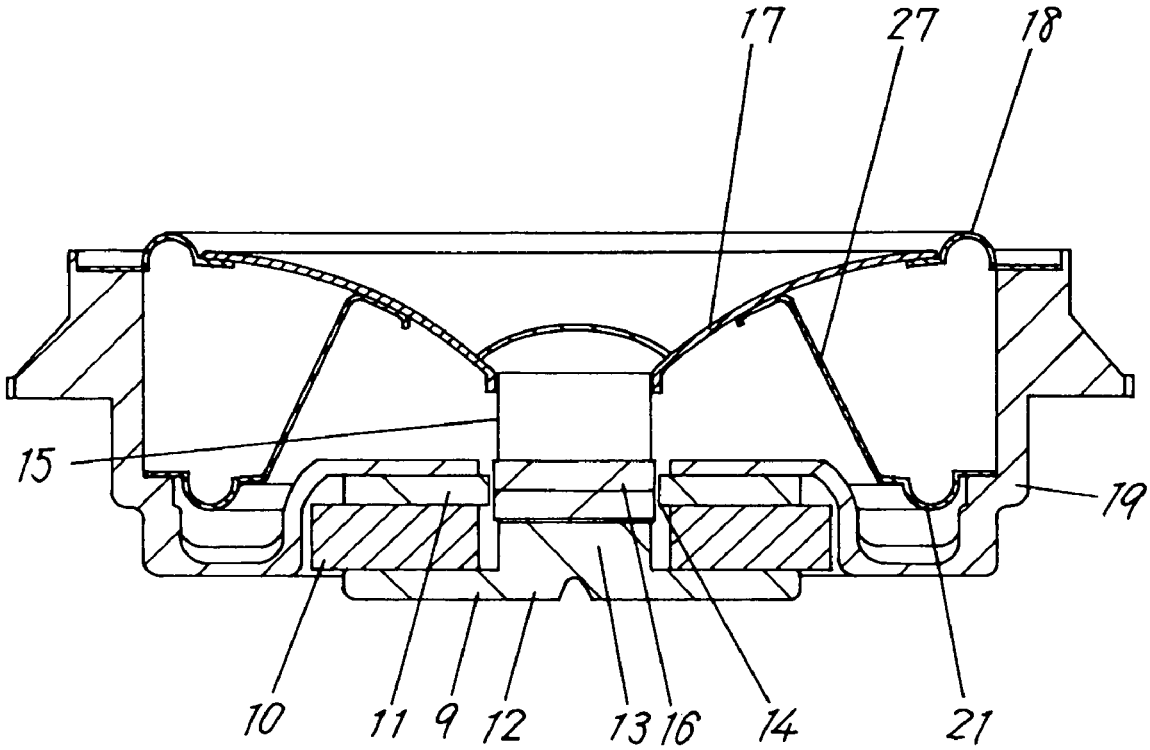
FIG. 9 is a sectional view of a loudspeaker in accordance with a seventh exemplary embodiment of the present invention.

The seventh exemplary embodiment is demonstrated hereinafter with reference to FIG. 9. FIG. 9 is a sectional view of a loudspeaker in accordance with the seventh exemplary embodiment of the present invention. The same constituent elements as described in the first through the sixth exemplary embodiments are identified with the same reference numerals.

In FIG. 9, an inner peripheral part of a cone shape suspension holder 27 is linked with a middle section between an inner peripheral part and an outer peripheral part of the diaphragm 17. An outer peripheral part of the suspension holder 27 is linked with the frame 19 via the second edge 21. Using the structure discussed above, the suspension holder 27 becomes much lighter, so that sound conversion efficiency of the loudspeaker is improved.

Eighth Exemplary Embodiment

Figure 10:
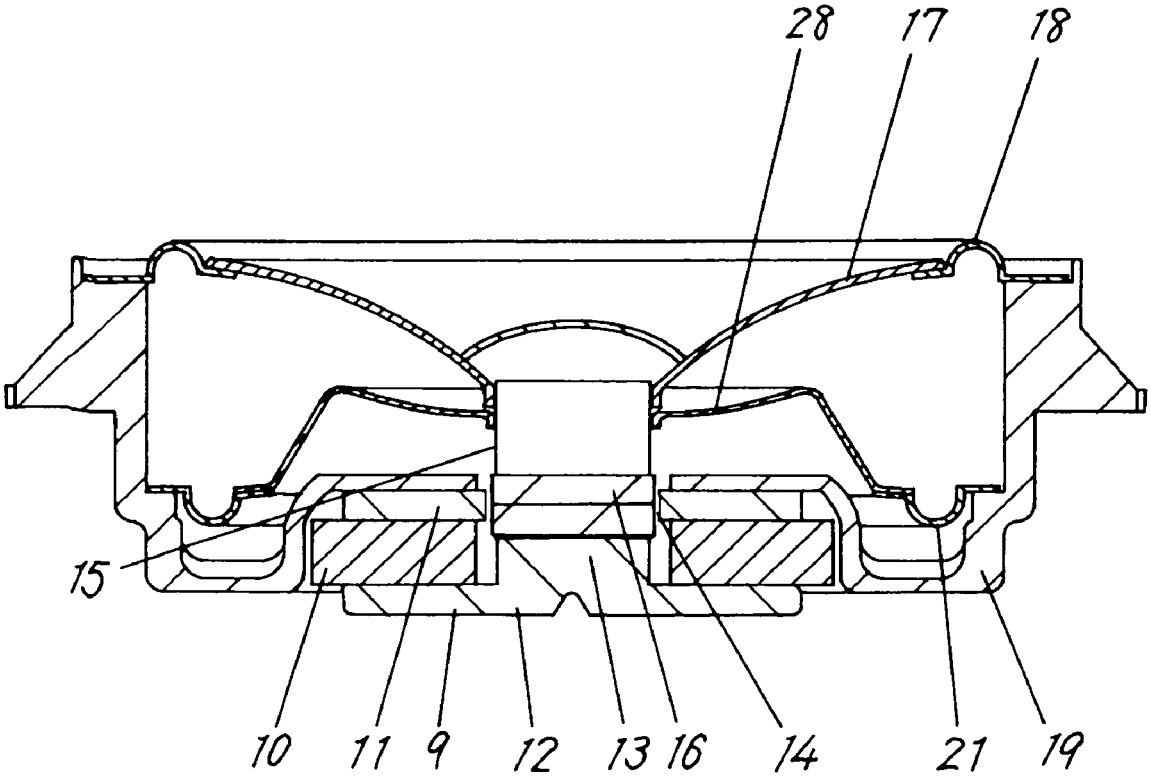
FIG. 10 is a sectional view of a loudspeaker in accordance with a eighth exemplary embodiment of the present invention.

The eighth exemplary embodiment is demonstrated hereinafter with reference to FIG. 10. FIG. 10 is a sectional view of a loudspeaker in accordance with the eighth exemplary embodiment of the present invention. The same constituent elements as described in the first through the seventh exemplary embodiments are identified with the same reference numerals.

In FIG. 10, metal material having high thermal conductivity is used for the suspension holder 28 and a bobbin of the voice coil member 15. Non-magnetic and light metal material such as aluminum is preferable.

Using the structure discussed above, heat generated from the voice coil member 15 is dissipated efficiently in an atmosphere via the bobbin of the voice coil member 15 and the suspension holder 28, so that a temperature rise of the voice coil member 15 is restricted. As a result, even if an adhesive, whose adhesive strength weakens at a high temperature, is used, the adhesive strength between the diaphragm 17, suspension holder 28 and voice coil member 15 is secured enough, so that input durability of the loudspeaker is improved.

Ninth Exemplary Embodiment

Figure 11:
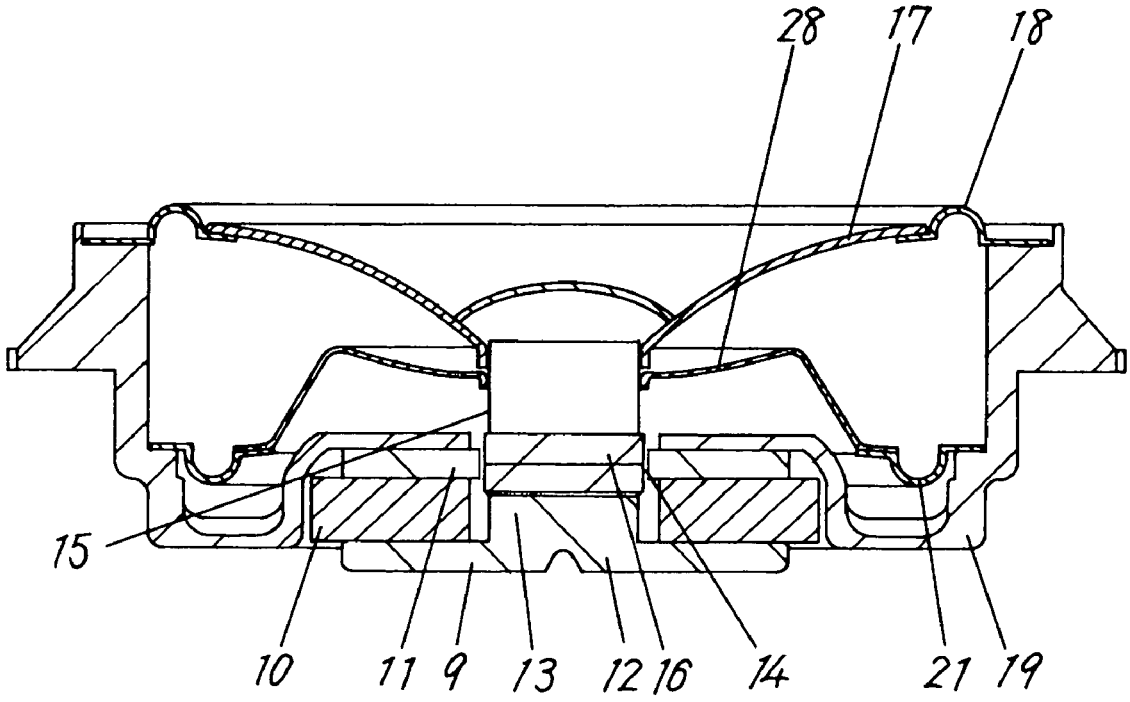
FIG. 11 is a sectional view of a loudspeaker in accordance with a ninth exemplary embodiment of the present invention.

The ninth exemplary embodiment is demonstrated hereinafter with reference to FIG. 11. FIG. 11 is a sectional view of a loudspeaker in accordance with the ninth exemplary embodiment of the present invention. The same constituent elements as described in the first through the eighth exemplary embodiments are identified with the same reference numerals.

In FIG. 11, the first edge 18 is protruded toward an opposite side of the magnetic circuit 9. The second edge 21 is protruded toward the magnetic circuit 9.

Using the structure discussed above, even if the first edge 18 is disposed near the second edge 21, contact between the first edge 18 and the second edge 21 during operation is avoided. As a result, maximum sound pressure becomes larger because a large amplitude allowance of the loudspeaker can be obtained.

Tenth Exemplary Embodiment

Figure 12:
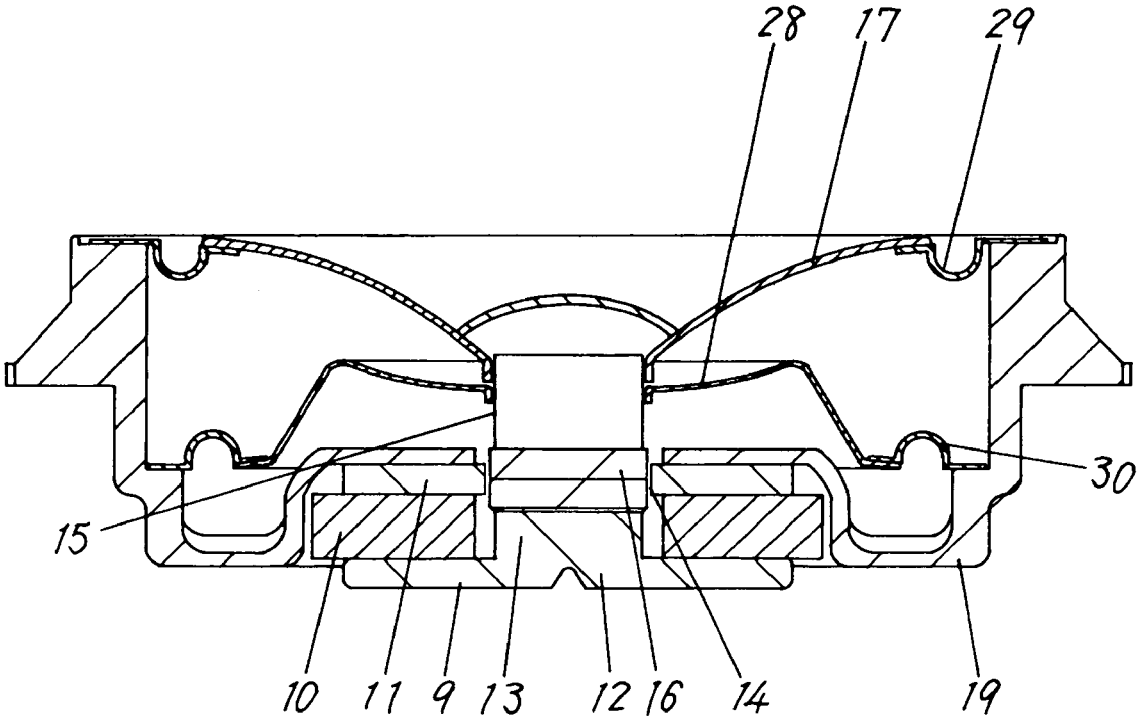
FIG. 12 is a sectional view of a loudspeaker in accordance with a tenth exemplary embodiment of the present invention.

The tenth exemplary embodiment is demonstrated hereinafter with reference to FIG. 12. FIG. 12 is a sectional view of a loudspeaker in accordance with the tenth exemplary embodiment of the present invention. The same constituent elements as described in the first through the ninth exemplary embodiments are identified with the same reference numerals.

In FIG. 12, the first edge 29 is protruded toward the magnetic circuit 9, and the second edge 30 is protruded toward the diaphragm 17.

Using the structure discussed above, even if a sound path opening such as a net is disposed adjacently in front of the first edge 29, contact between the first edge 29 and the net is avoided. As a result, maximum sound pressure becomes larger because a large amplitude allowance of the loudspeaker can be obtained.

Eleventh Exemplary Embodiment

Figure 13:
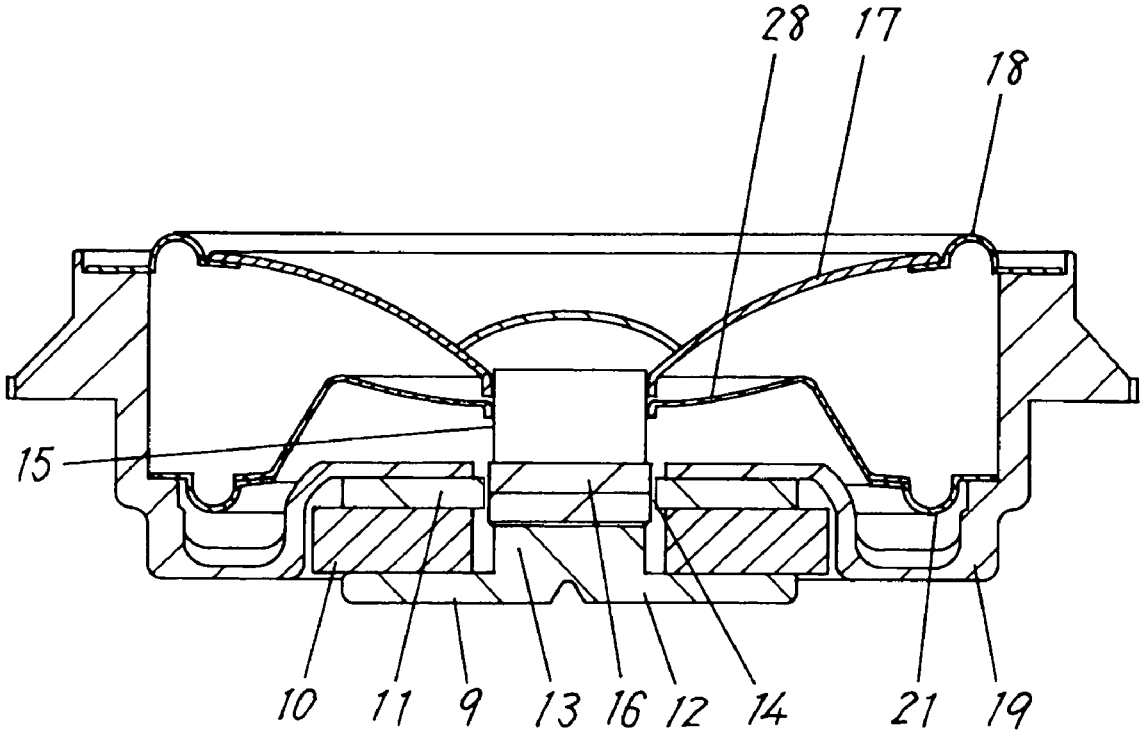
FIG. 13 is a sectional view of a loudspeaker in accordance with a eleventh exemplary embodiment of the present invention.

The eleventh exemplary embodiment is demonstrated hereinafter with reference to FIG. 13. FIG. 13 is a sectional view of a loudspeaker in accordance with the eleventh exemplary embodiment of the present invention. In FIG. 13, the first edge 18 is substantially identical to the second edge 21 in elastic coefficient.

Using the structure discussed above, the first edge 18 and the second edge 21 can cancel their own non-linearity and asymmetry exactly, so that harmonic distortion and power linearity, which is caused by non-linearity and asymmetry, of the loudspeaker is improved.

Twelfth Exemplary Embodiment

Figure 14:
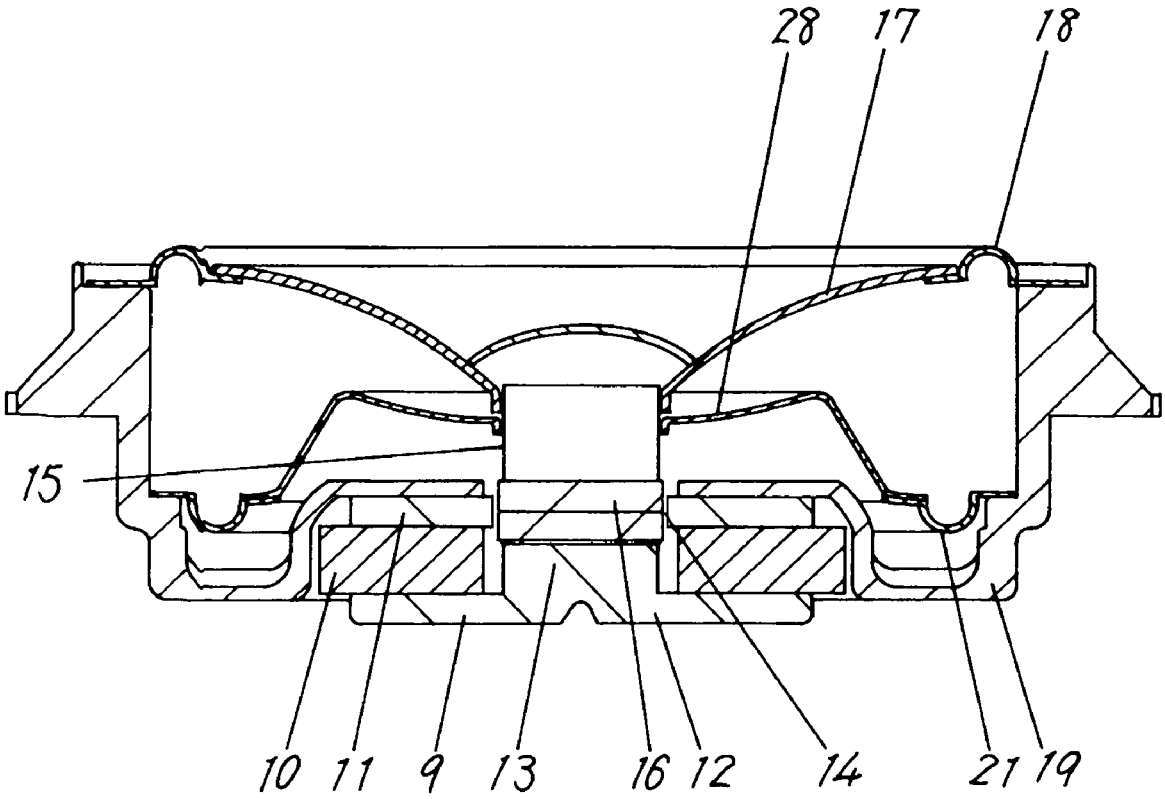
FIG. 14 is a sectional view of a loudspeaker in accordance with a twelfth exemplary embodiment of the present invention.

The twelfth exemplary embodiment is demonstrated hereinafter with reference to FIG. 14. FIG. 14 is a sectional view of a loudspeaker in accordance with the twelfth exemplary embodiment of the present invention. In FIG. 14, the first edge 18 and the second edge 21 are made of urethane.

Using the structure discussed above, the loudspeaker including the first edge 18 and the second edge 21 of this embodiment can reduce an increasing rate of weight of the vibration system, where the vibration system includes a diaphragm, voice coil member, and the first and second edges. As a result, deterioration of efficiency due to increase of weight is prevented, because the vibration system is light.

Thirteenth Exemplary Embodiment

Figure 15:
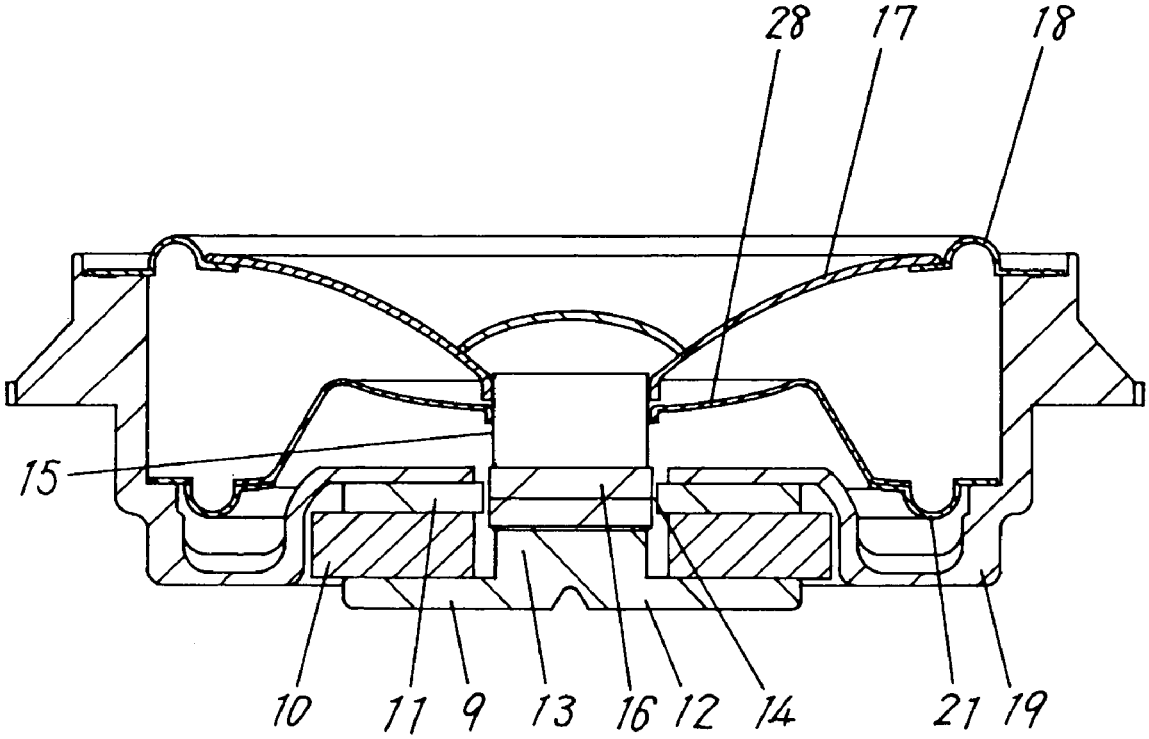
FIG. 15 is a sectional view of a loudspeaker in accordance with a thirteenth exemplary embodiment of the present invention.

The thirteenth exemplary embodiment is demonstrated hereinafter with reference to FIG. 15. FIG. 15 is a sectional view of a loudspeaker in accordance with the thirteenth exemplary embodiment of the present invention. In FIG. 15, the suspension holder 28 is made of pulp.

Using the structure discussed above, the loudspeaker can secure a high elastic coefficient and a large internal loss, and reduce weight of the vibration system. As a result, even if the loudspeaker becomes bigger, deterioration of efficiency is prevented, because the vibration system is light.

Fourteenth Exemplary Embodiment

Figure 16:
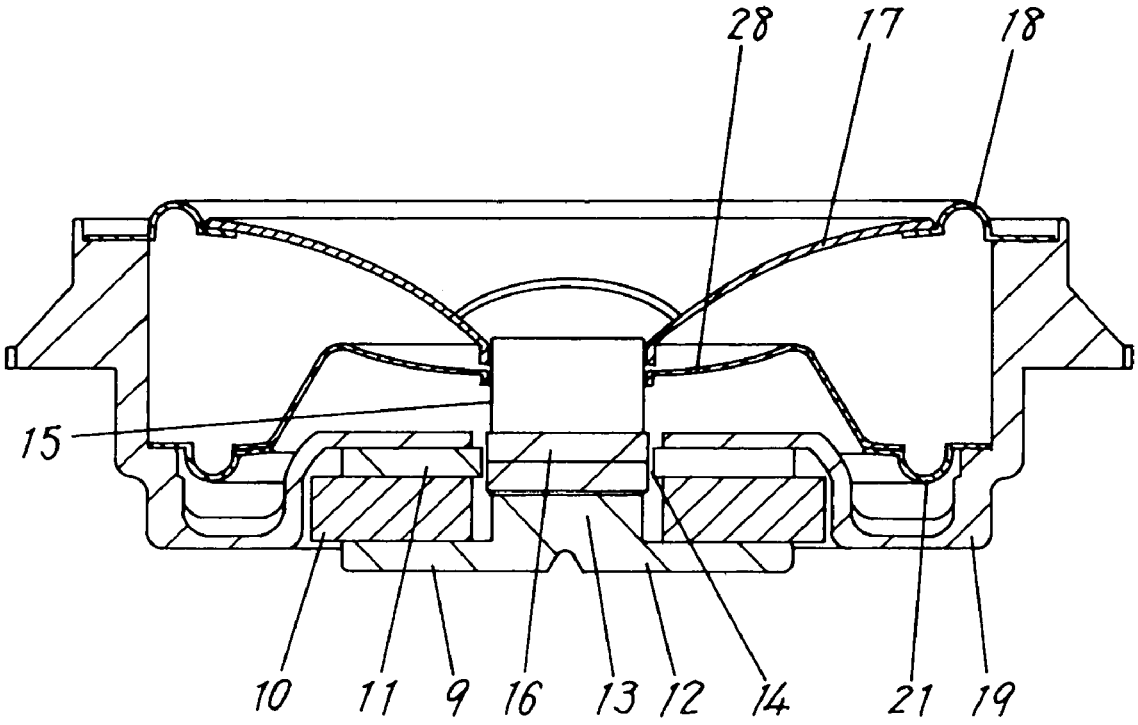
FIG. 16 is a sectional view of a loudspeaker in accordance with a fourteenth exemplary embodiment of the present invention.

The fourteenth exemplary embodiment is demonstrated hereinafter with reference to FIG. 16. FIG. 16 is a sectional view of a loudspeaker in accordance with the fourteenth exemplary embodiment of the present invention. The same constituent elements as described in the first through the thirteenth exemplary embodiments are identified with the same reference numerals.

In FIG. 16, an outer peripheral part of the suspension holder 28 is placed closer to the magnetic circuit 9 than an inner peripheral part of the frame 19, and linked with the frame 19 via the second edge 21. As a result, a distance between a fulcrum of the first edge 18 and a fulcrum of the second edge 21 is expanded maximally, thereby preventing the voice coil member 15 from rolling during operation.

Fifteenth Exemplary Embodiment

Figure 17:
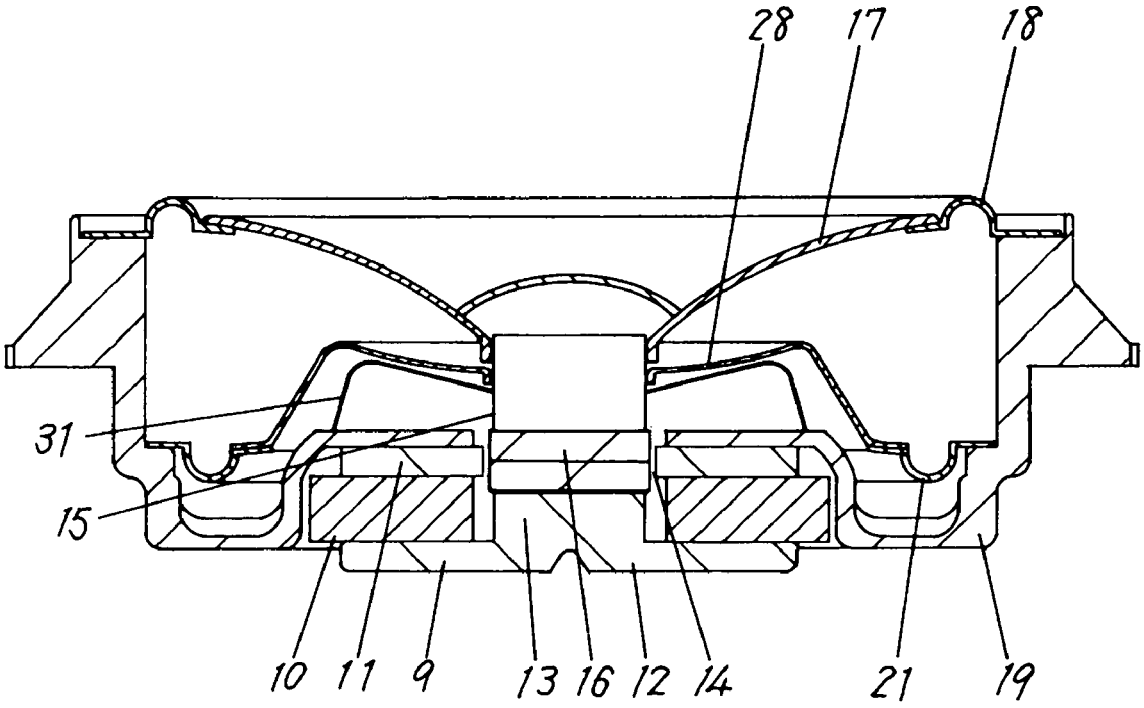
FIG. 17 is a sectional view of a loudspeaker in accordance with a fifteenth exemplary embodiment of the present invention.

The fifteenth exemplary embodiment is demonstrated hereinafter with reference to FIG. 17. FIG. 17 is a sectional view of a loudspeaker in accordance with the fifteenth exemplary embodiment of the present invention. The same constituent elements as described in the first through the fourteenth exemplary embodiments are identified with the same reference numerals.

In FIG. 17, a dustproof net 31 is placed between the voice coil member 15 and the frame 19, thereby preventing dust and the like from entering into the magnetic gap 14 of the magnetic circuit 9.

Sixteenth Exemplary Embodiment

Figure 18:
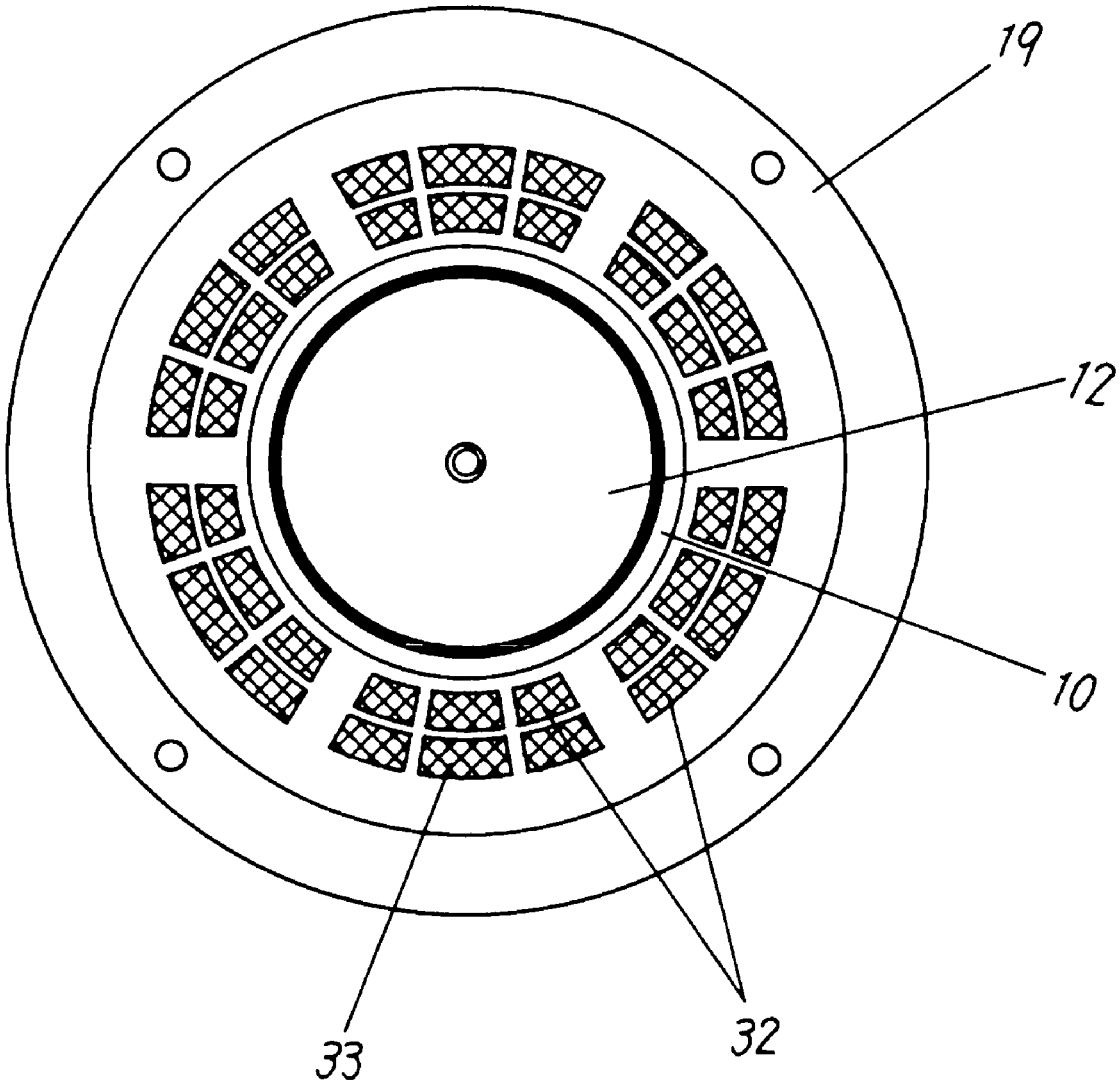
FIG. 18 is a rear view of a loudspeaker in accordance with a sixteenth exemplary embodiment of the present invention.

The sixteenth exemplary embodiment is demonstrated hereinafter with reference to FIG. 18. FIG. 18 is a rear view of a loudspeaker in accordance with the sixteenth exemplary embodiment of the present invention. The same constituent elements as described in the first through the fifteenth exemplary embodiments are identified with the same reference numerals.

In FIG. 18, an inner end of the frame 19 is linked with the magnetic circuit 9, and an inner end section (bottom side) of the frame 19 includes vent holes 32 having the dustproof net 31, thereby preventing dust and the like from entering into the magnetic gap 14 of the magnetic circuit 9.

Seventeenth Exemplary Embodiment

Figure 19:
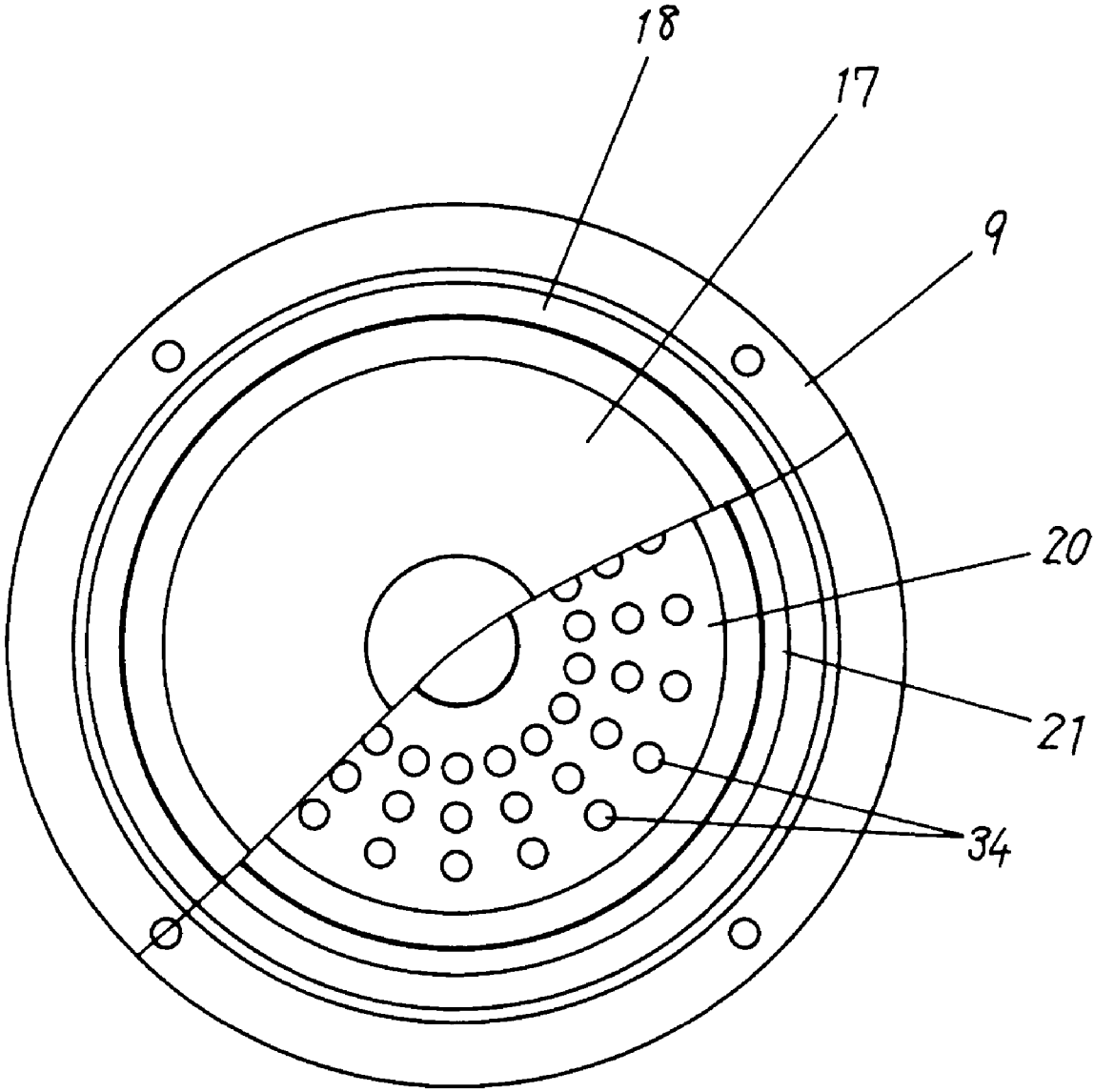
FIG. 19 is a partially cutaway front view of a loudspeaker in accordance with a seventeenth exemplary embodiment of the present invention.

The seventeenth exemplary embodiment is demonstrated hereinafter with reference to FIG. 19. FIG. 19 is a partially cutaway front view of a loudspeaker in accordance with the seventeenth exemplary embodiment of the present invention. The same constituent elements as in the first exemplary embodiment are identified with the same reference numerals.

In FIG. 19, openings 34 are formed at the suspension holder 20. The structure mentioned above prevents a sound output of the suspension holder 20 from interfering with the diaphragm 17, thereby preventing deterioration of sound characteristics.

Eighteenth Exemplary Embodiment

Figure 20:
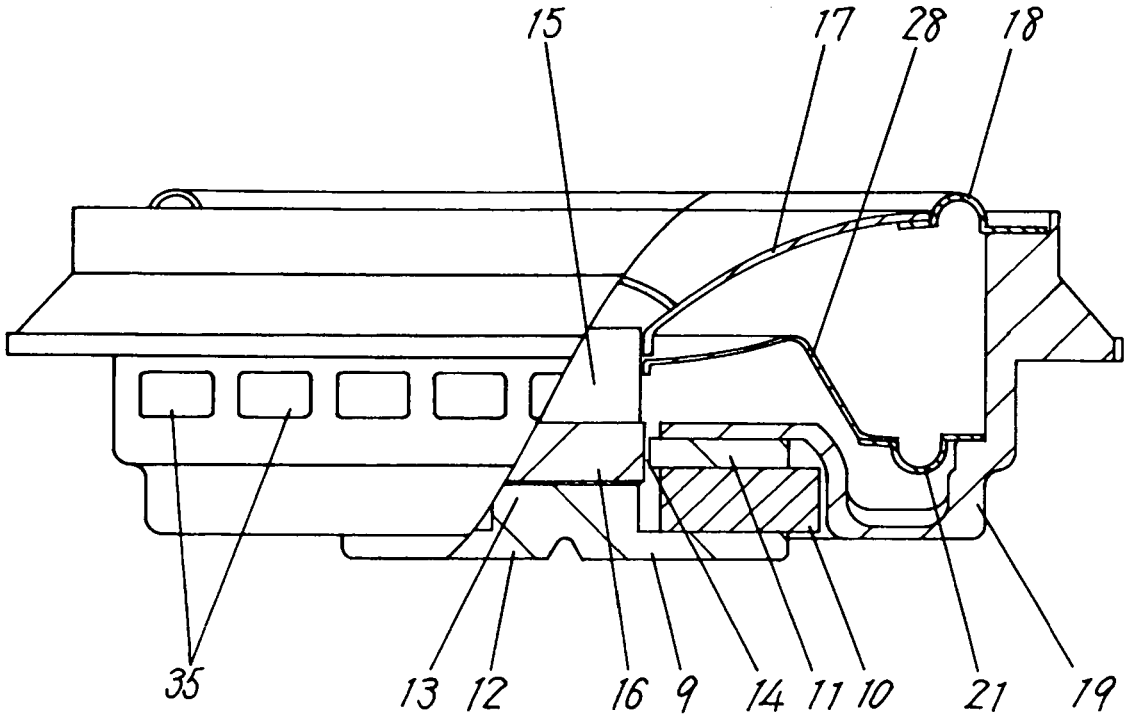
FIG. 20 is a partially cutaway sectional view of a loudspeaker in accordance with a eighteenth exemplary embodiment of the present invention.

The eighteenth exemplary embodiment is demonstrated hereinafter with reference to FIG. 20. FIG. 20 is a partially cutaway sectional view of the loudspeaker in accordance with a eighteenth exemplary embodiment of the present invention. The same constituent elements as described in the first through the seventeenth exemplary embodiments are identified with the same reference numerals.

In FIG. 20, between the first edge 18 and the second edge 21, openings 35 are formed at the frame 19. The structure mentioned above prevents the diaphragm 17, first edge 18, frame 19, second edge 21, suspension holder 28 and voice coil member 15 from forming an intermediate chamber. If the intermediate chamber is formed, a sound output of the suspension holder 28 interferes with the diaphragm 17, and sound characteristics deteriorate. Openings 35 prevent this deterioration.

Nineteenth Exemplary Embodiment

Figure 21:
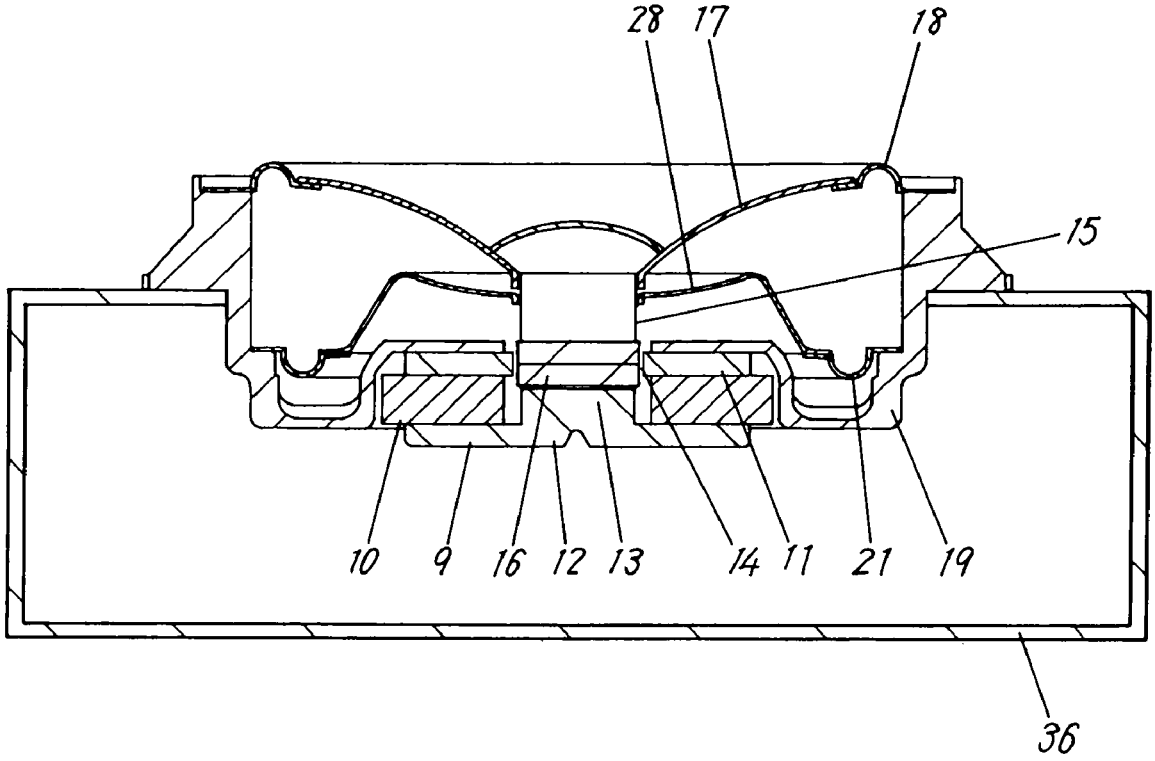
FIG. 21 is a sectional view of a loudspeaker in accordance with a nineteenth exemplary embodiment of the present invention.
Figure 22:
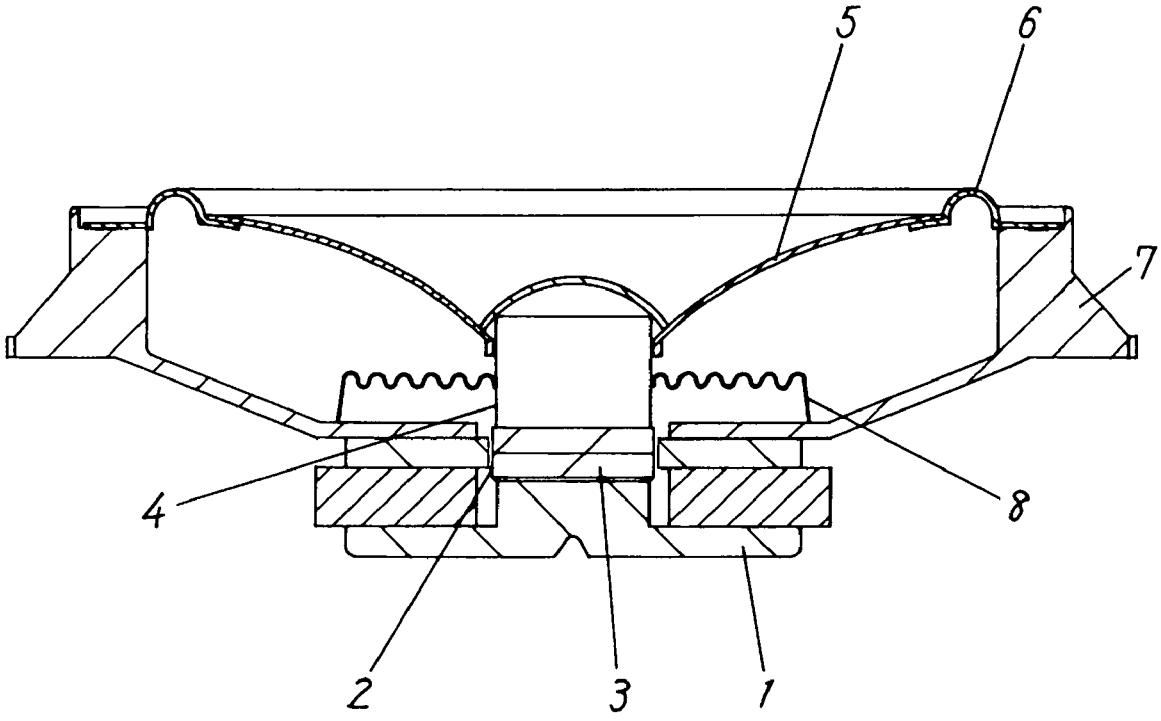
FIG. 22 PRIOR ART
FIG. 22 is a sectional view of a conventional loudspeaker.
Figure 23:
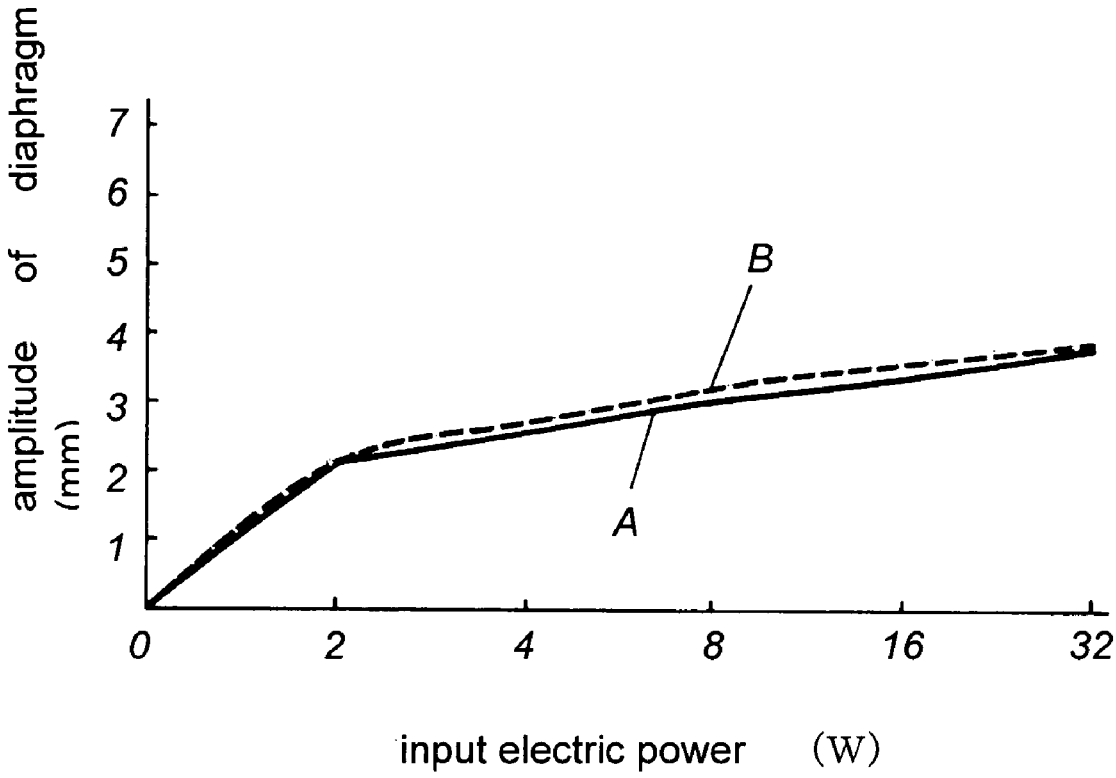
FIG. 23 PRIOR ART
FIG. 23 is a graph showing a characteristic of power linearity of the conventional loudspeaker.
Figure 24:
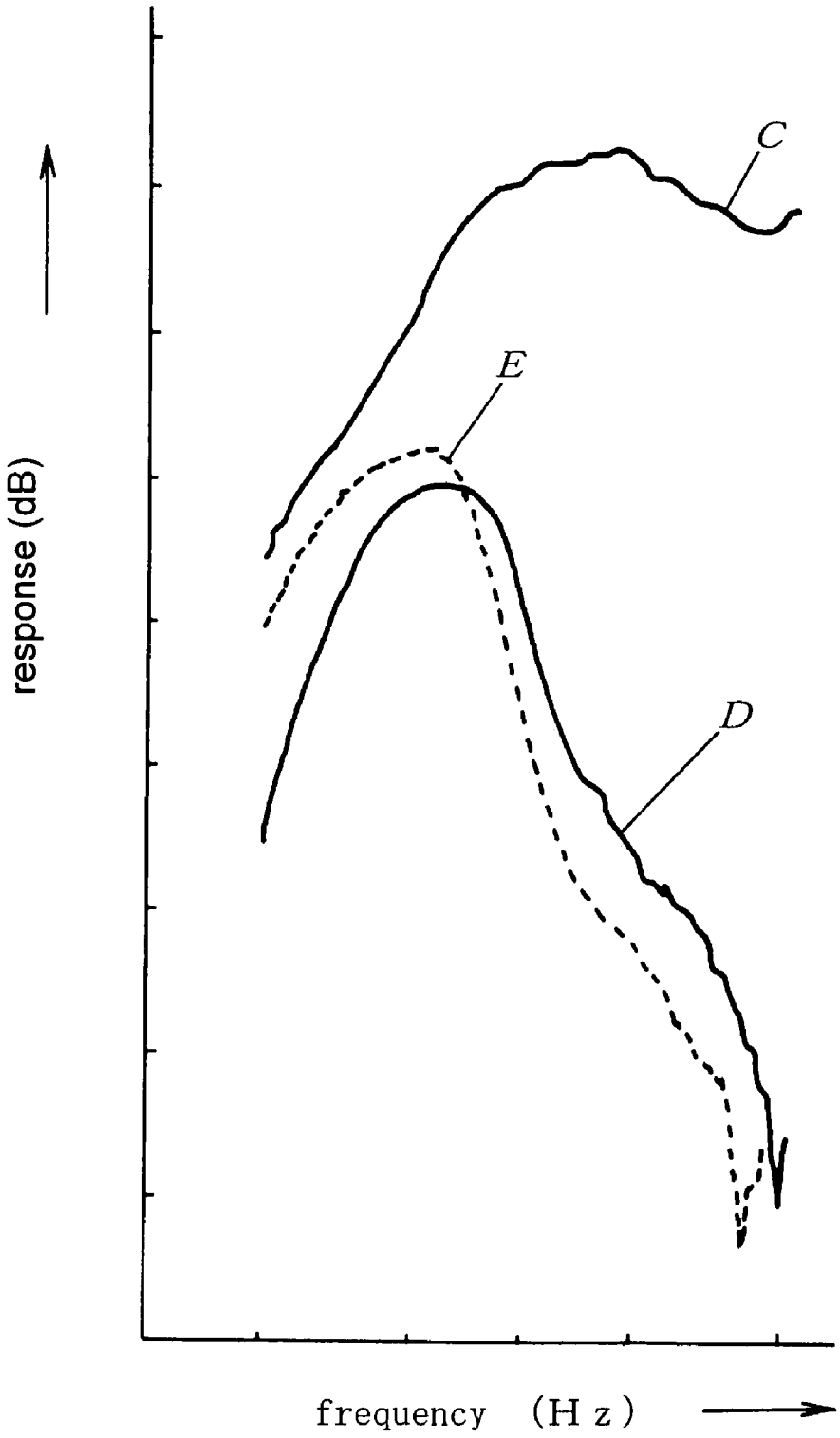
FIG. 24 PRIOR ART
FIG. 24 is a graph showing a characteristic of harmonic distortion of the conventional loudspeaker.

The nineteenth exemplary embodiment is demonstrated hereinafter with reference to FIG. 21. FIG. 21 is a sectional view of a loudspeaker in accordance with the nineteenth exemplary embodiment of the present invention. The same constituent elements as described in the first through the eighteenth exemplary embodiments are identified with the same reference numerals.

In FIG. 21, a cabinet 36, which is a rather small box, is fixed to the loudspeaker of the first through eighteenth embodiment of this invention, and an elastic coefficient of the second edge 21 is larger than that of the first edge 18.

Using the structure discussed above, even if the loudspeaker is used in the rather small cabinet 36, a suitable suspension characteristic can be obtained using an air cushion, first edge 18 and second edge 21. As a result, nonlinearity and asymmetry are canceled exactly, so that harmonic distortion of the loudspeaker is reduced and power linearity thereof is improved.

INDUSTRIAL APPLICABILITY

As discussed above, in this invention, a loudspeaker forming a suspension by a first edge and a second edge can reduce harmonic distortion and improve power linearity, thereby increasing its performance.

What is claimed is:

1. A loudspeaker comprising:

a magnetic circuit including a magnetic gap;

a voice coil member disposed in the magnetic gap of said magnetic circuit and having a movable coil;

a suspension holder having an inner peripheral part linked with said voice coil member outside the magnetic gap;

a frame linked with an outer peripheral part of said suspension holder via a second edge; and a diaphragm having an inner peripheral part linked with a middle section of said suspension holder, and having an outer peripheral part linked with said frame via a first edge;

wherein the first edge and the second edge are substantially symmetrical with each other about a median of the first edge and the second edge.

2. A loudspeaker as claimed in claim 1, wherein a bobbin of said voice coil member and said suspension holder are made of metal.

3. A loudspeaker as claimed in claim 2, wherein said magnetic circuit is covered with a cabinet at an opposite side of said diaphragm, and the second edge is larger than the first edge in their elastic coefficients.

4. A loudspeaker as claimed in claim 1, wherein the first edge is protruded toward an opposite side of said magnetic circuit, and the second edge is protruded toward said magnetic circuit.

5. A loudspeaker as claimed in claim 4, wherein the first edge is substantially identical to the second edge in their elastic coefficients.

6. A loudspeaker as claimed in claim 4, wherein the first edge and the second edge are made of urethane.

7. A loudspeaker as claimed in claim 4, wherein said suspension holder is made of pulp.

8. A loudspeaker as claimed in claim 4, wherein the outer peripheral part of said suspension holder is placed closer to said magnetic circuit than an inner peripheral part of said frame, and is linked with said frame via the second edge.

9. A loudspeaker as claimed in claim 4, further comprising a dustproof net disposed between said suspension holder and said magnetic circuit.

10. A loudspeaker as claimed in claim 4, wherein an inner end of said frame is linked with said magnetic circuit, and an inner end section of said frame includes a vent hole having a dustproof net.

11. A loudspeaker as claimed in claim 4, wherein an opening is formed at said suspension holder.

12. A loudspeaker as claimed in claim 4, wherein an opening is formed between the first edge and the second edge at said frame.

13. A loudspeaker as claimed in claim 4, wherein said magnetic circuit is covered with a cabinet at an opposite side of said diaphragm, and the second edge is larger than the first edge in their elastic coefficients.

14. A loudspeaker as claimed in claim 1, wherein the first edge is protruded toward said magnetic circuit, and the second edge is protruded toward said diaphragm.

15. A loudspeaker as claimed in claim 14, wherein the first edge is substantially identical to the second edge in their elastic coefficients.

16. A loudspeaker as claimed in claim 14, wherein the first edge and the second edge are made of urethane.

17. A loudspeaker as claimed in claim 14, wherein said suspension holder is made of pulp.

18. A loudspeaker as claimed in claim 14, wherein the outer peripheral part of said suspension holder is placed closer to said magnetic circuit than an inner peripheral part of said frame, and is linked with said frame via the second edge.

19. A loudspeaker as claimed in claim 14, further comprising a dustproof net disposed between said suspension holder and said magnetic circuit.

20. A loudspeaker as claimed in claim 14, wherein an inner end of said frame is linked with said magnetic circuit, and an inner end section of said frame includes a vent hole having a dustproof net.

21. A loudspeaker as claimed in claim 14, wherein an opening is formed at said suspension holder.

22. A loudspeaker as claimed in claim 14, wherein an opening is formed between the first edge and the second edge at said frame.

23. A loudspeaker as claimed in claim 14, wherein said magnetic circuit is covered with a cabinet at an opposite side of said diaphragm, and the second edge is larger than the first edge in their elastic coefficients.

* * * * *